United States Patent [19]

Kramer

[11] Patent Number: 5,022,254

[45] Date of Patent: Jun. 11, 1991

[54] METHOD AND DEVICE FOR THE MANUFACTURE OF CAN BODIES BY EXTENSION, INCLUDING EXPANSION OF THE DIAMETER AND REDUCTION OF THE THICKNESS OF THE SHEET METAL, STARTING OUT FROM A CAN BODY WITH SMALLER DIAMETER, MADE OF THICKER SHEET METAL

[76] Inventor: Antonio H. Kramer, Rua Zeferey, 1439, Jundiaí, Sao Paulo, Brazil

[21] Appl. No.: 387,840

[22] Filed: Aug. 1, 1989

[30] Foreign Application Priority Data

Aug. 9, 1988 [BR] Brazil ..... 8804178

[51] Int. Cl.[5] ..... B21D 41/02

[52] U.S. Cl. ..... 72/393; 413/69

[58] Field of Search ..... 413/69, 71, 72, 78; 72/355, 393

[56] References Cited

U.S. PATENT DOCUMENTS

| | | | |
|---|---|---|---|
| 2,405,399 | 8/1946 | Bugg et al. | 72/355 |
| 3,459,028 | 10/1966 | Bijvoet | 413/69 |
| 3,466,920 | 9/1969 | Parker | 72/393 |
| 3,581,546 | 6/1971 | Raget | 413/69 |
| 3,635,073 | 1/1972 | Oliver | 72/393 |
| 4,064,730 | 12/1977 | Gerretz | 72/393 |
| 4,065,953 | 1/1978 | Frentzen et al. | 72/393 |
| 4,198,844 | 4/1980 | Lowe et al. | 72/393 |
| 4,753,101 | 6/1988 | Shultz | 72/393 |

*Primary Examiner*—D. S. Meislin

*Attorney, Agent, or Firm*—Fleit, Jacobson, Cohn, Price, Holman & Stern

[57] ABSTRACT

A device for expanding a tubular can body has a circular array of expansion blades which are inserted into the body and expanded by means of a central tapering shaft which is driven axially through a corresponding bore of the blade by a hydraulic piston and cylinder assembly. The ends of the blades are supported for radially expanding movement by a cylindrical housing which has an annular end wall received in peripheral channels formed in the individual blades. The channels have sufficient depth to accommodate the required radial expansion and retraction movements of the blades.

3 Claims, 7 Drawing Sheets

METHOD AND DEVICE FOR THE MANUFACTURE OF CAN BODIES BY EXTENSION, INCLUDING EXPANSION OF THE DIAMETER AND REDUCTION OF THE THICKNESS OF THE SHEET METAL, STARTING OUT FROM A CAN BODY WITH SMALLER DIAMETER, MADE OF THICKER SHEET METAL

BACKGROUND OF THE INVENTION

1. Field of the Invention

The Invention refers to a method and device for the manufacture of can bodies by extension, including expansion of the can diameter and reduction of the thickness of the sheet metal, and this, starting out from the utilization of a smaller diameter cylindrical can body, manufactured from thicker sheet metal.

SUMMARY OF THE INVENTION

The referred to method and corresponding device allows further, besides the productions of metal cans in a more economical manner, due to substantial material savings and sensible cost reduction, that the cans, by using the same device and the same expansion and extension operation, be obtained with a diameter reduction at their ends, thus allowing the utilization of smaller diameter caps, with sensible sheet metal savings also for the caps, and further the formation, by the same method and device, during the operation, of beads, ridges or facets for reinforcing the can body, either crosswise or lengthwise.

The new method for the manufacture of can bodies by expansion and extension and by transforming an originally smaller diameter cylindrical can body of thicker sheet metal, into a larger diameter can with thinner walls, as well as the device destinated for the performance of the method, are represented on the attached drawings, where we have:

DESCRIPTION OF THE PREFERRED EMBODIMENT

Figure 1:
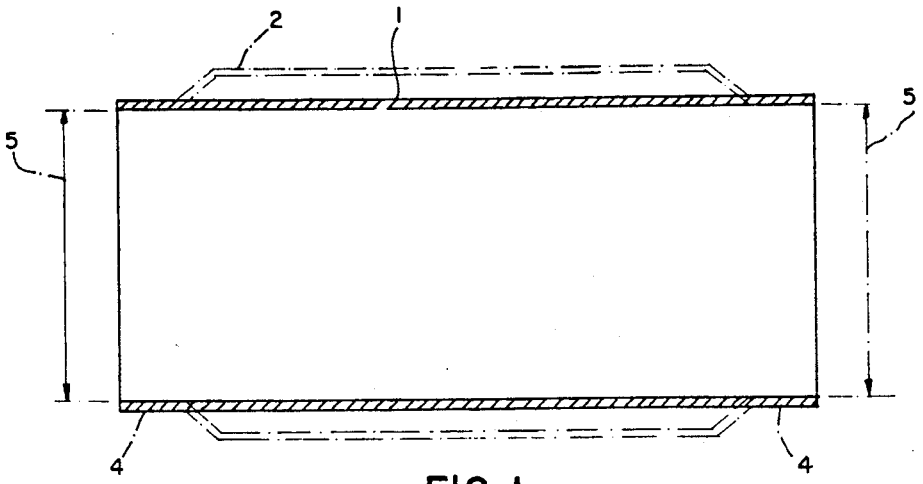
FIG. 1—a diametrical section side view in of a metal can body of smaller diameter made from thicker sheet metal than the resulting product, this figure showing in dotted lines the can body with the shape acquired after the expansion and extension process, i.e., already expanded with larger diameter and thinner walls.
Figure 2:
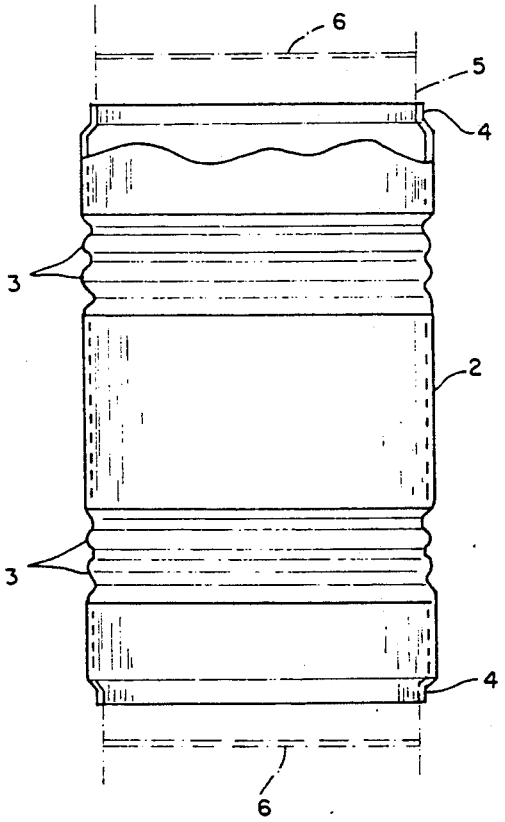
FIG. 2—side view of a can, partially cut, obtained by the method, where may result, in addition to the diameter increase of the can body and reduction of wall thickness, maintaining the diameter on both ends, the formation of reinforcement beads or facets, both axial or lengthwise, obtained by the same expansion and extension operation.
Figure 3:
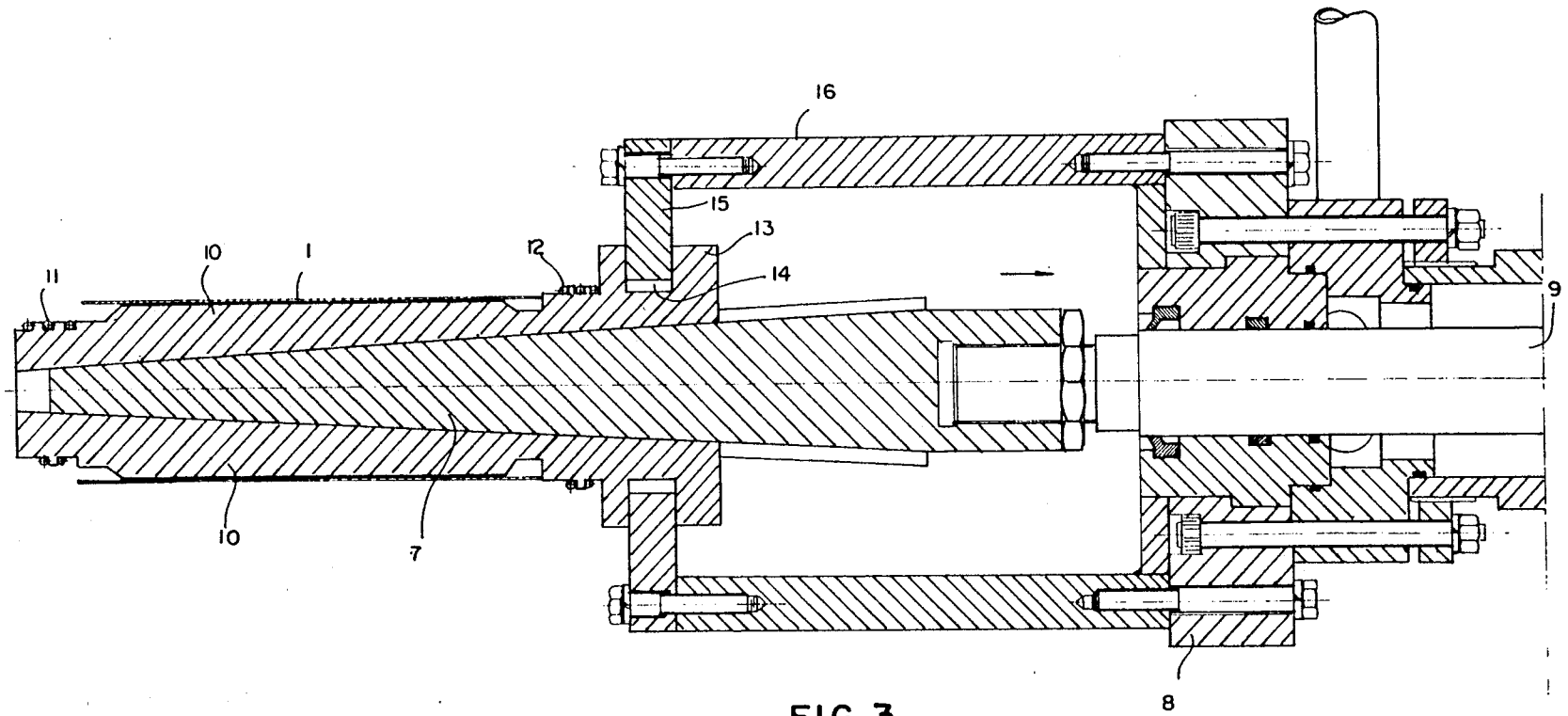
FIG. 3—a diametrical section of the expansion device in its resting position with its extremity applied to a can of which the diameter is to be expanded.
Figure 4:
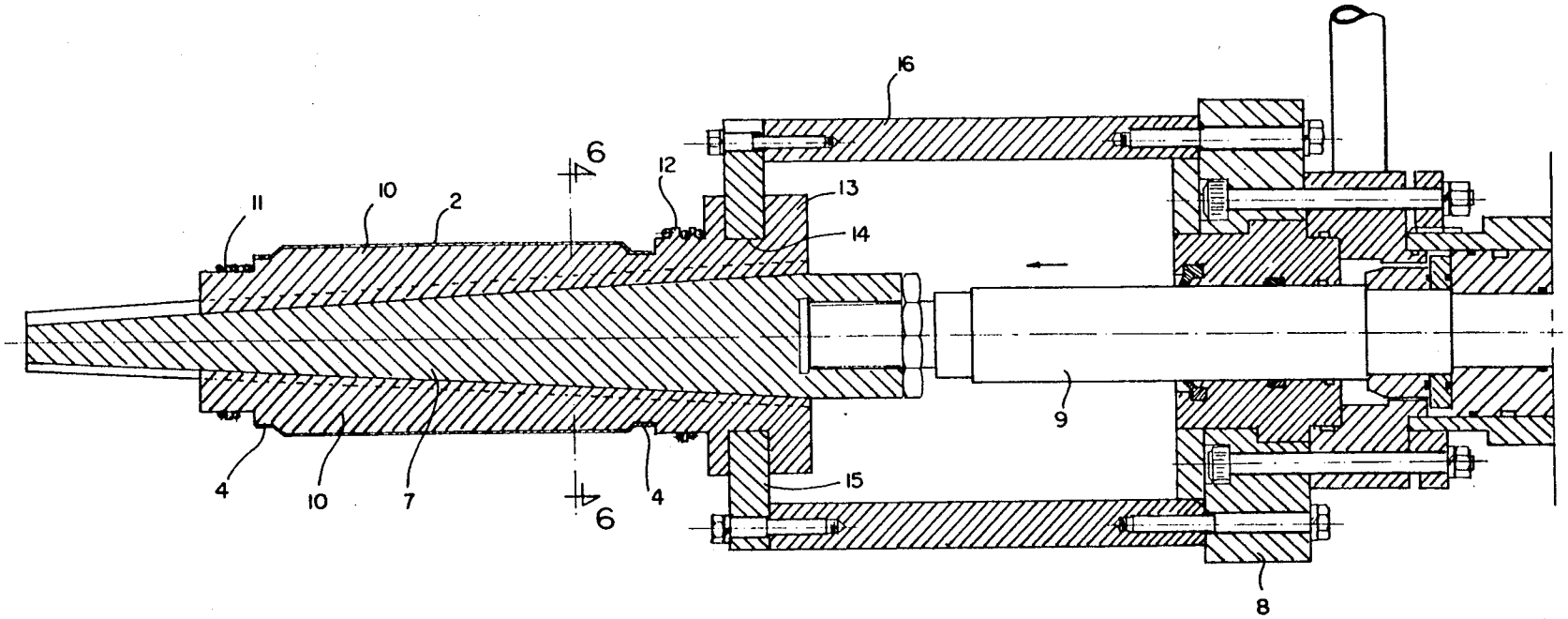
FIG. 4—the same side view in diametrical section of the device, after having been operated and in its final expansion position of the can body, increasing its diameter and reducing the thickness of the sheet metal from which it has been molded.

Describing in more details the referred to method and corresponding device for the manufacture of can bodies by extension, expanding the diameter and reducing the thickness of the sheet metal, by the utilization or starting from a smaller diameter can body, originally made from thicker sheet metal and according to FIGS. 1 and 2, shown as examples, where we see the practical results of the new process, where a can body 1, normally made from sheet metal and originally of smaller diameter, as by example, 73 mm and with a sheet metal thickness of 0.6 mm, when submitted to the referred to method and by- -means of using the device, the result is the production of a can body 2 of larger diameter, i.e., 83 mm, with a wall thickness of 0.1 mm.

By the same method and using the same device is obtained by the same operation of expansion and extension of the sheet metal, the shaping of beads or ridges 3, reinforcing the can body, which may be obtained by changes of the back of the expansion blades of the device, both in circular or axial direction, as in the lengthwise direction of the can body, maintaining, however, the same initial or original diameter of the can body 1 at its ends 4, which will remain at the diameter of 73 mm, as shown by arrows 5, thus allowing the use of smaller diameter caps 6 with substantial materials savings also for the caps.

For better evaluating the advantages of the method it is convenient to note further that in the conventional rolling methods for reducing the thickness of the sheet metal, the reductions are subject to certain limitations, being impossible to obtain lower thicknesses. By the method under appreciation a substantial reduction below these limits can be obtained, thanks to the extension caused by the expansion of the can bodies themselves, and this within parameters quite below those obtained by conventional rolling processes, thus obtaining a lighter can with excellent structural resistance conditions, provided by the circular or axial beads 3, or by the longitudinal facets and with substantial increase of the volumetric capacity of the can.

Figure 5:
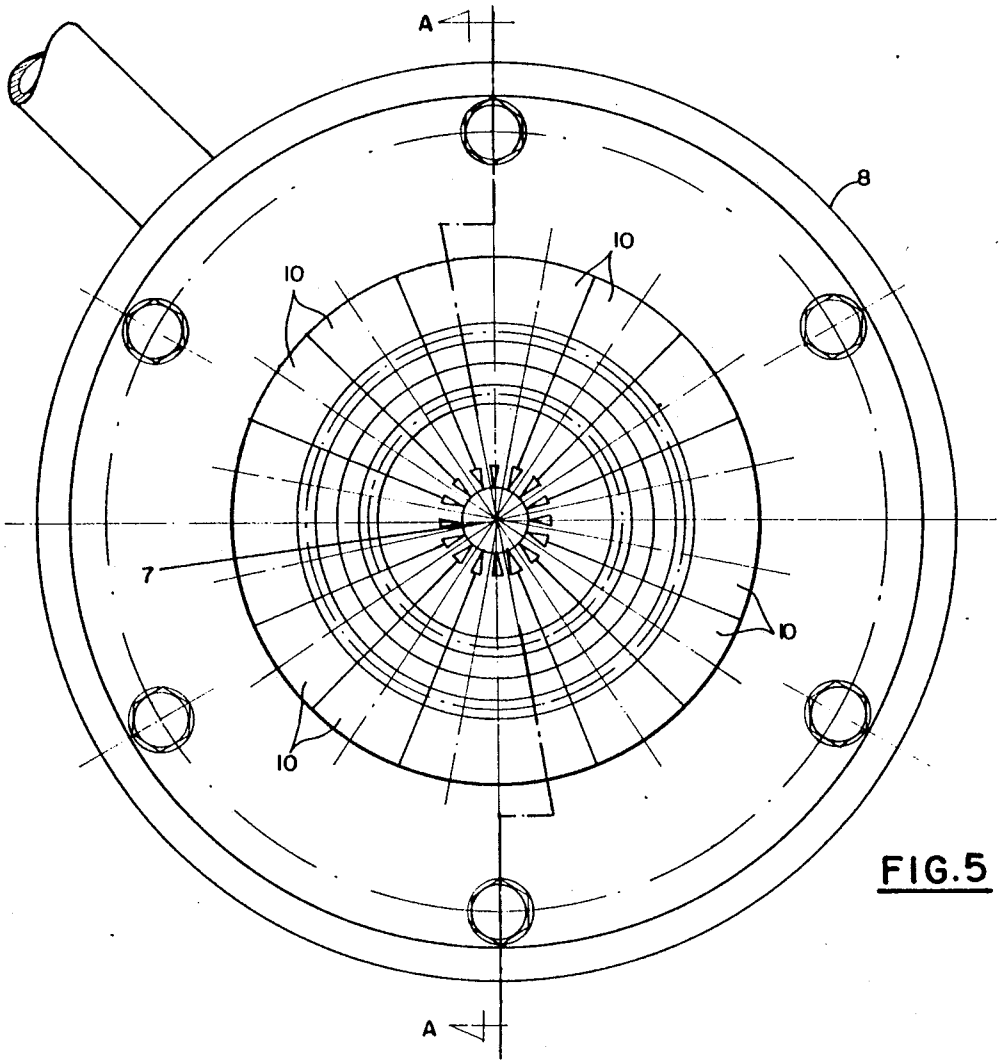
FIG. 5—front view of the expansion device, which, for explanatiory purposes, has its expansion blades in the resting position.
Figure 6:
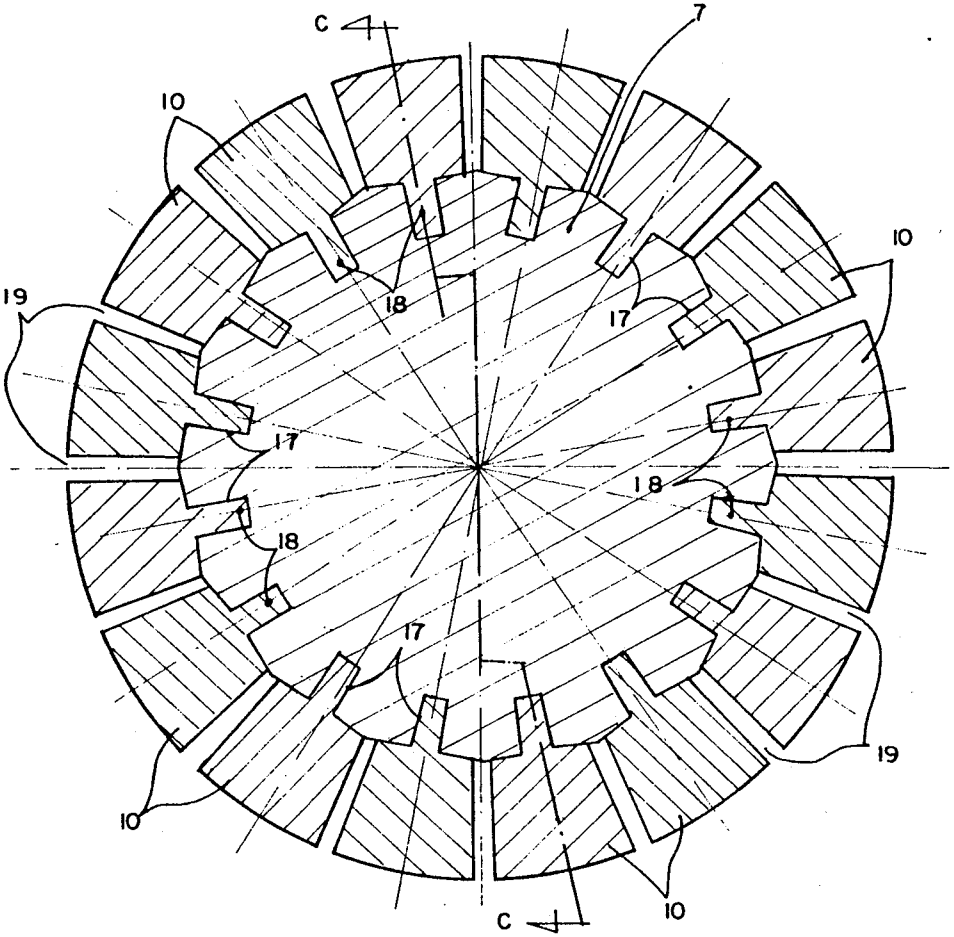
FIG. 6—cross section view of the device, as indicated by line B—B of FIG. 4 with its expansion blades in the maximum expansion position.
Figure 7:
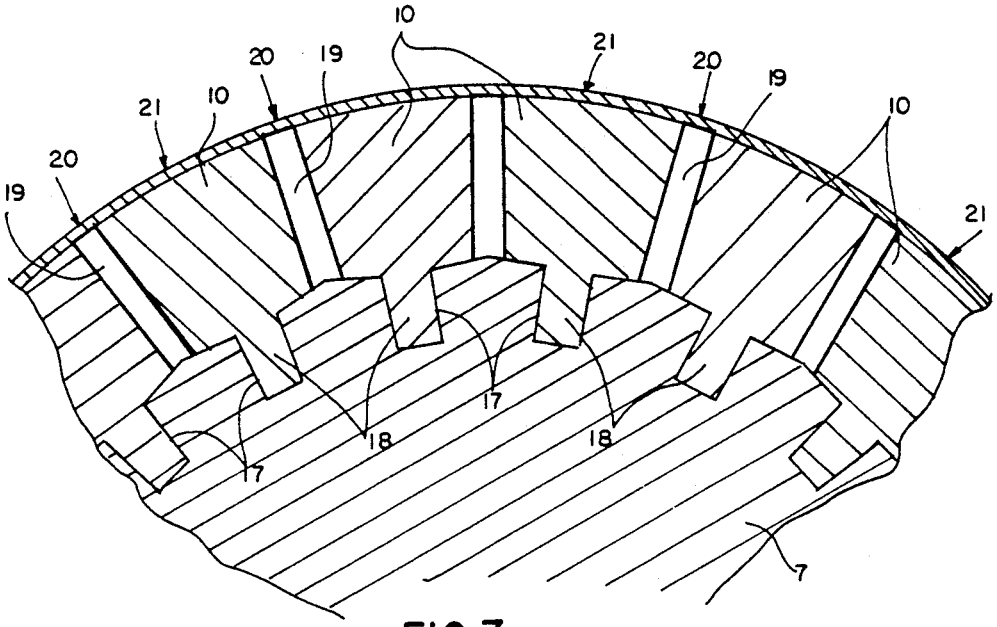
FIG. 7—detail view, showing in cross section a sector of the expansion blade assembly of the device, the shape or cross section of these blades mating the shaping of arced facets of the can body, intercalated by narrow plane longitudinal facets, providing reinforcements to the expanded can body.

Referring to the device which allows the performance of the manufacturing method of cans by extension, with expansion of the diameter and reduction of the sheet metal thickness, the same, as shown particularly by FIGS. 3, 4, 5 and 6, is basically formed by a central cylindrical shaft 7, placed lengthwise, spiked and fusiform, adequately assembled to a supporting assembly 8 and actuated in its longitudinal movements by a hydraulic piston 9, or eventually by some other mechanical, pneumatical, etc. system, interconnected to the base of the conical shaft 7, around of which are assembled, as a cluster, a plurality of expansion blades 10, presenting themselves with a generally trapezoid cross section, disposed radially, side by side, in form of a fan, as better seen at FIGS. 5 and 6, said blades having their backs or outer faces preferably arched in the outside direction, or in circular sections, in order to compose a circular external periphery, of which each one of the backs of the blades 10 constitutes a segment or sector of the circle.

Said expansible blades are maintained around the conical shaft 7, constantly pressed against the conical surface of that shaft, by means of elastic compression elements, formed, in this case, by coil springs 11 and 12, which involve the extremities and bases of the expansion blades 10, the bases or rear extremities of this blade assembly showing a development 13 shaped as a circular head, provided laterally with a circular channel 14, in which is maintained by snap-in action the inner edge of a ring 15, adequately fixed in a cylindrical housing 16 which is part of the support 8, and serves as the stabilizing guide for the expansion blade assembly, in order that these may operate orderly in their expansion and retraction movements, transmitted to them by the conical shaft 7.

These expansion and retraction movements of the expansion blades 10 are further guided by a plurality of channels 17, provided in regular spaces and in longitudinal direction in the conical shaft 7, where are maintained, by snap-in action, the internal and tapered ends 18 of the blades 10, in such a way, to form stabilizing and orientating guides for the movements of the blades around the conical shaft 7.

Obeying this constructive configuration, the mentioned device, by which is permitted the performance of the manufacturing method of can bodies by extension, with expansion of diameter and reduction of the thickness of the sheet metal, presents the following way of functioning:

After introduction of the can body into the end of the expanding device, formed by the assembly of expansion blades 10, these being in the resting position and maintaining the can perfectly centered, the can originally manufactured with a smaller diameter and thicker sheet metal, by actuating the hydraulic system 9 of the device, the advance of the conical shaft 7 will cause the blades 10 to expand, which, by means of their backs, will exercize strong pressure against the inner face of the wall of the can, uniform and at the whole surface of the inner wall, causing at the same time the expansion and consequent diameter increase of the can in relation to its original diameter, as well as the extension of the sheet metal, resulting in a sensible thickness reduction, as per example shown at FIGS. 1 and 2.

As a consequence of this expansion operation and due to the moving away of the points of pressure on the lateral walls of the blades 10, normally propped when in the resting position, will be formed on the outer circumference of the blade assembly small spaces 19 of which result, in the expanded can body, a plurality of plane facets 20, inserted between the curved or arched streches 21, and these facets will provide structural reinforcement to the can body.

Obviously, the operations of the expanding device shall be performed automatically, allowing the performance of a large number of operations in series, by means of adequate equipment, as for example, a pinwheel for receiving the cans, operating in synchronization with the devices, in adequate number for the desired production, allowing large scale production of expanded cans.

After the operation is finished and the conical shaft 7 having returned to its resting position, the blades will recede around the shaft by spring action 11 and 12, the device then being in condition to again start operations.

Figure 8:
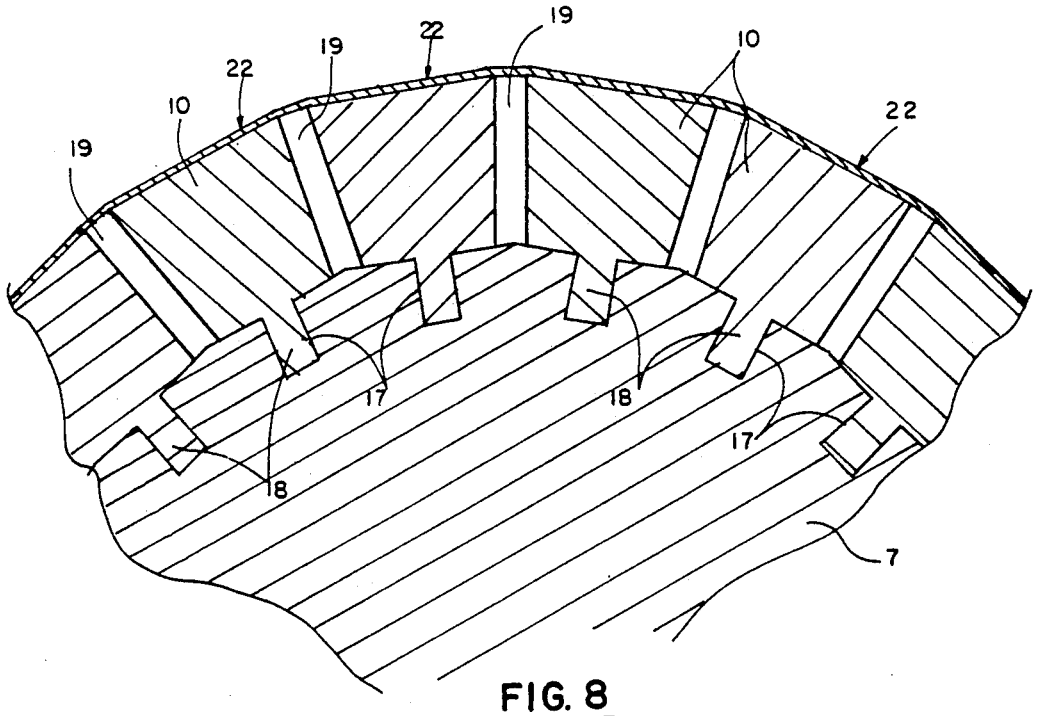
FIG. 8—detailed view, showing in cross section a sector of the expansion blade assembly of the device, its appropriate shape or section permitting the shaping of an expanded can body of non-cylindrical cross section, i.e., a faceted can with four or more faces.
Figure 10:
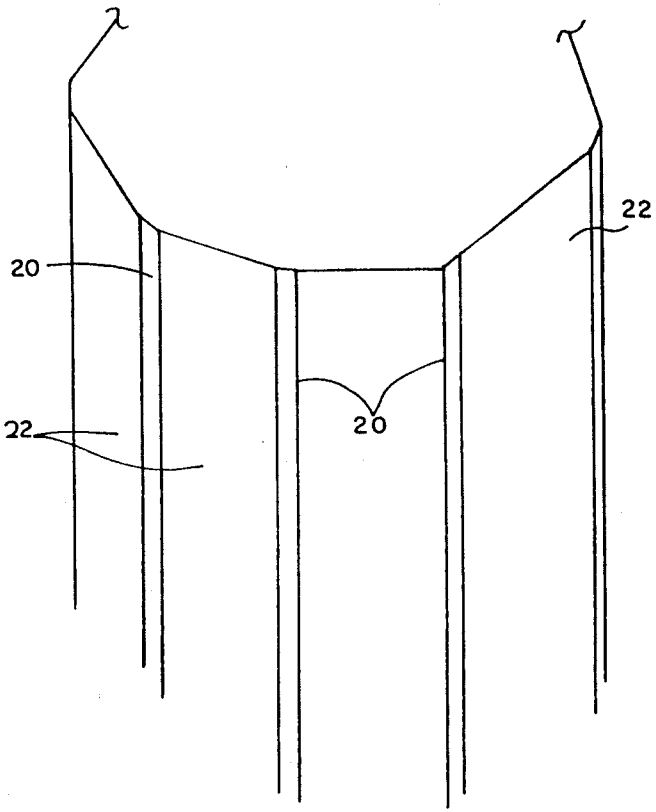
FIG. 10—perspective view of part of an expanded can body, with a non-cylindric body, i.e., with plane longitudinal facets.
Figure 9:
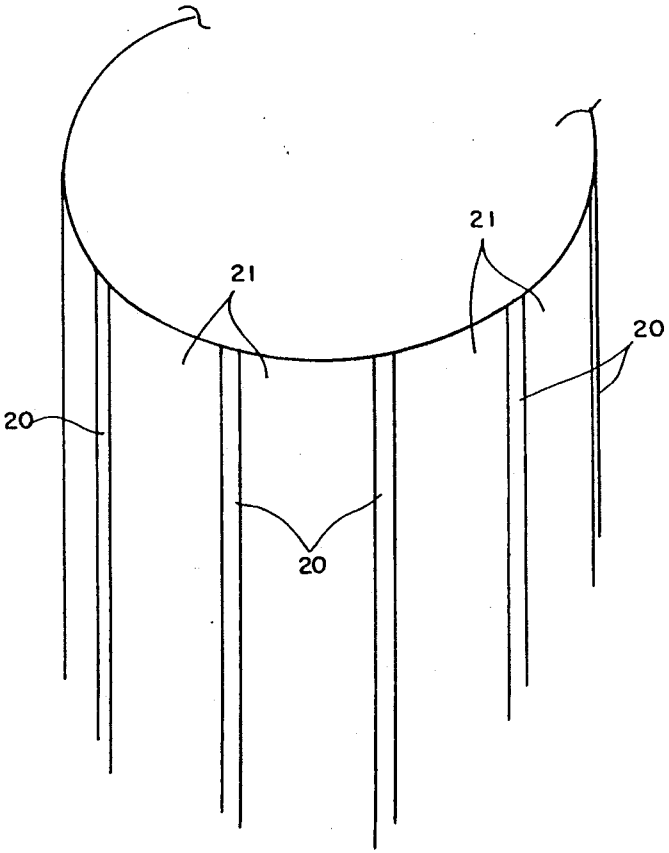
FIG. 9—perspective view of part of an expanded can body, of generally circular or cylindrical cross section, with narrow longitudinal facets.

Although the main purpose of the method under apreciation is to allow the production of more economical cans, by which a can, normally destinated to hold a smaller volume of contents, gets a sensibly larger volume capacity, in addition to provide sensible savings by the smaller diameter caps, the new method and respective performing device allow further to obtain cans with the same advantages of expansion and reduction of the sheet metal thickness, of non-cylindrical bodies for decoration or embellishment of the containers, such as, for example, square cross section cans or with any number of plane facets 22, as shown as example by FIGS. 8 and 10, with bodies presenting themselves by a plurality of plane facets, being sufficient for that purpose change the shape or profile of the expansion blades 10, as in the example of FIG. 8, where we can see the back of the blades 10 in an even shape, which is transferred to the can body by the expansion process.

I claim:

1. A device for manufacturing a can body by expansion of a cylindrical blank, comprising a substantially cylindrical expansion device for fitting inside the blank and including means for effecting radial expansion of the expansion device against the inside of the blank, the expansion device being of a predetermined length to expand the blank in a region intermediate the opposite ends of the blank, wherein the means for effecting radial expansion of the expansion device comprises an elongate frusto-conical central shaft, mounted at one end to a support member, and a plurality of elongate expansion blades arranged circumferentially around the central shaft, and held in position around the central shaft by spring means at the opposite ends of the blades, the central shaft being capable of lengthwise reciprocal movement relative to the expansion blades, the shaft and the blades being guided during said relative movement by mutually engaging longitudinally extending formations on the shaft and the blades, respectively, such that during movement of the shaft in one direction, the blades are expanded radially outwardly against the bias of the spring means and during movement of the shaft in the opposite direction, the blades are retracted radially inwardly by the spring means, and wherein the support member forms part of a cylindrical housing which includes a hydraulic piston attached to one end of the central shaft, for effecting the reciprocal movement thereof and the other end of the shaft projecting through an annular end wall of the housing and the expansion blades surrounding the shaft at a location which is outside the housing, the expansion blades having formations on their ends facing the cylindrical housing which collectively form a circular head having a channel extending around its periphery which engages with the annular end wall of the housing to permit the said radial expansion and retraction of the blades.

2. The device according to claim 1, wherein the expansion blades are generally of a trapezoid traverse cross section and having backs or outer faces which are curved so that the outer faces of the blades collectively define a circular outline.

3. The device according to claim 1, wherein the expansion blades are generally of a trapezoid trasverse cross section and having backs or outer faces which are substantially flat so that the outer faces of the blades collectively define a multifaceted outline.

* * * * *